US012372022B1

(12) United States Patent
Kiwan et al.

(10) Patent No.: US 12,372,022 B1
(45) Date of Patent: Jul. 29, 2025

(54) EXHAUST SYSTEM VALVE DIAGNOSTICS

(71) Applicant: Ford Global Technologies, LLC, Dearborn, MI (US)

(72) Inventors: Rani Kiwan, West Bloomfield, MI (US); Michiel J. Van Nieuwstadt, Ann Arbor, MI (US); Chris Paul Glugla, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 18/781,461

(22) Filed: Jul. 23, 2024

(51) Int. Cl.
*F01N 11/00* (2006.01)
*F01N 13/00* (2010.01)
*F01N 13/10* (2010.01)

(52) U.S. Cl.
CPC ..... *F01N 11/007* (2013.01); *F01N 13/008* (2013.01); *F01N 13/107* (2013.01); *F01N 2240/36* (2013.01); *F01N 2470/14* (2013.01); *F01N 2560/025* (2013.01); *F01N 2900/0416* (2013.01)

(58) Field of Classification Search
CPC .... F01N 11/007; F01N 13/008; F01N 13/107; F01N 2240/36; F01N 2470/14; F01N 2560/025; F01N 2900/0416
See application file for complete search history.

(56) References Cited

U.S. PATENT DOCUMENTS

| | | | | |
|---|---|---|---|---|
| 4,926,634 | A * | 5/1990 | Putz | F01N 13/011 60/299 |
| 5,018,349 | A * | 5/1991 | Pemberton | F01N 13/04 60/323 |
| 5,384,098 | A * | 1/1995 | Morikawa | F01N 3/2046 422/111 |
| 9,683,505 | B2 | 6/2017 | Santillo et al. | |
| 11,499,471 | B2 | 11/2022 | Zhang et al. | |
| 2004/0098970 | A1 | 5/2004 | Foster | |
| 2007/0051092 | A1 | 3/2007 | Pallett et al. | |
| 2018/0171867 | A1 | 6/2018 | Ulrey et al. | |
| 2021/0033008 | A1 | 2/2021 | Naclerio | |

FOREIGN PATENT DOCUMENTS

| | | | |
|---|---|---|---|
| JP | H06159045 | A * | 11/1992 |
| JP | 2004245061 | A * | 9/2004 |

OTHER PUBLICATIONS

Kiwan, R. et al., "Methods and Systems to Compensate for Oxygen Sensor Bias," U.S. Appl. No. 18/801,055, filed Aug. 12, 2024, 34 pages.

* cited by examiner

*Primary Examiner* — Audrey B. Walter
(74) *Attorney, Agent, or Firm* — Vincent Mastrogiacomo; McCoy Russell LLP

(57) ABSTRACT

Systems and methods for diagnosing operation of valves that control exhaust flow through crossover pipes are described. In one example, the diagnostics may be based on output of upstream and downstream oxygen sensors. In particular, correlation between output of an upstream oxygen sensor and a downstream oxygen sensor may be indicative of a valve not being in an expected position.

8 Claims, 6 Drawing Sheets

EXHAUST SYSTEM VALVE DIAGNOSTICS

FIELD

The present description relates to a system and methods for diagnosing whether or not a valve in an exhaust system is operating as may be expected. The methods and systems may be particularly beneficial to exhaust systems that include oxygen sensors.

BACKGROUND AND SUMMARY

Components of an internal combustion engine may be diagnosed to determine whether or not the components are operating as may be expected. The components may be diagnosed if they may affect engine and tailpipe emissions. If a component is determined to be degraded, an indication of the degraded component may be provided to vehicle occupants. The vehicle occupants may take the vehicle in for service upon receiving an indication of a degraded engine component. One way to diagnose an emissions related component is to add sensors that sense operation of the component. However, adding additional sensors to an engine may increase the financial expense and complexity of the engine. Therefore, it may be desirable to omit the additional sensors, but not at the expense of not being able to determine whether or not the component is operating as may be desired.

The inventors herein have recognized the above-mentioned disadvantages and have developed an exhaust system valve diagnostic method, comprising: via a controller, adjusting a position of a valve in an exhaust system in response to an indication of valve degradation, where the indication of valve degradation is based on output of at least two oxygen sensors.

By diagnosing operation of a valve within an exhaust system based on oxygen sensor output, it may be possible to provide the technical result of being able to diagnose the valve without having to add additional sensors to determine whether or not the valve may be operating as expected. In one example, outputs of two oxygen sensors may be a basis for determining whether or not a valve in the exhaust system is operating as may be expected. In particular, a correlation coefficient may be determined according to output of an upstream oxygen sensor and a downstream oxygen sensor. If the correlation coefficient is smaller than may be expected for an operational valve, it may be determined that the valve is not operating as may be expected and the valve may be degraded.

The present description may provide several advantages. In particular, the approach may reduce system expense and complexity. Further, the approach may increase robustness of valve diagnostics. Additionally, the approach may perform diagnostics on valves in either their pass through state or their bypass state.

The above advantages and other advantages, and features of the present description will be readily apparent from the following Detailed Description when taken alone or in connection with the accompanying drawings.

It may be understood that the summary above is provided to introduce in simplified form a selection of concepts that are further described in the detailed description. It is not meant to identify key features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
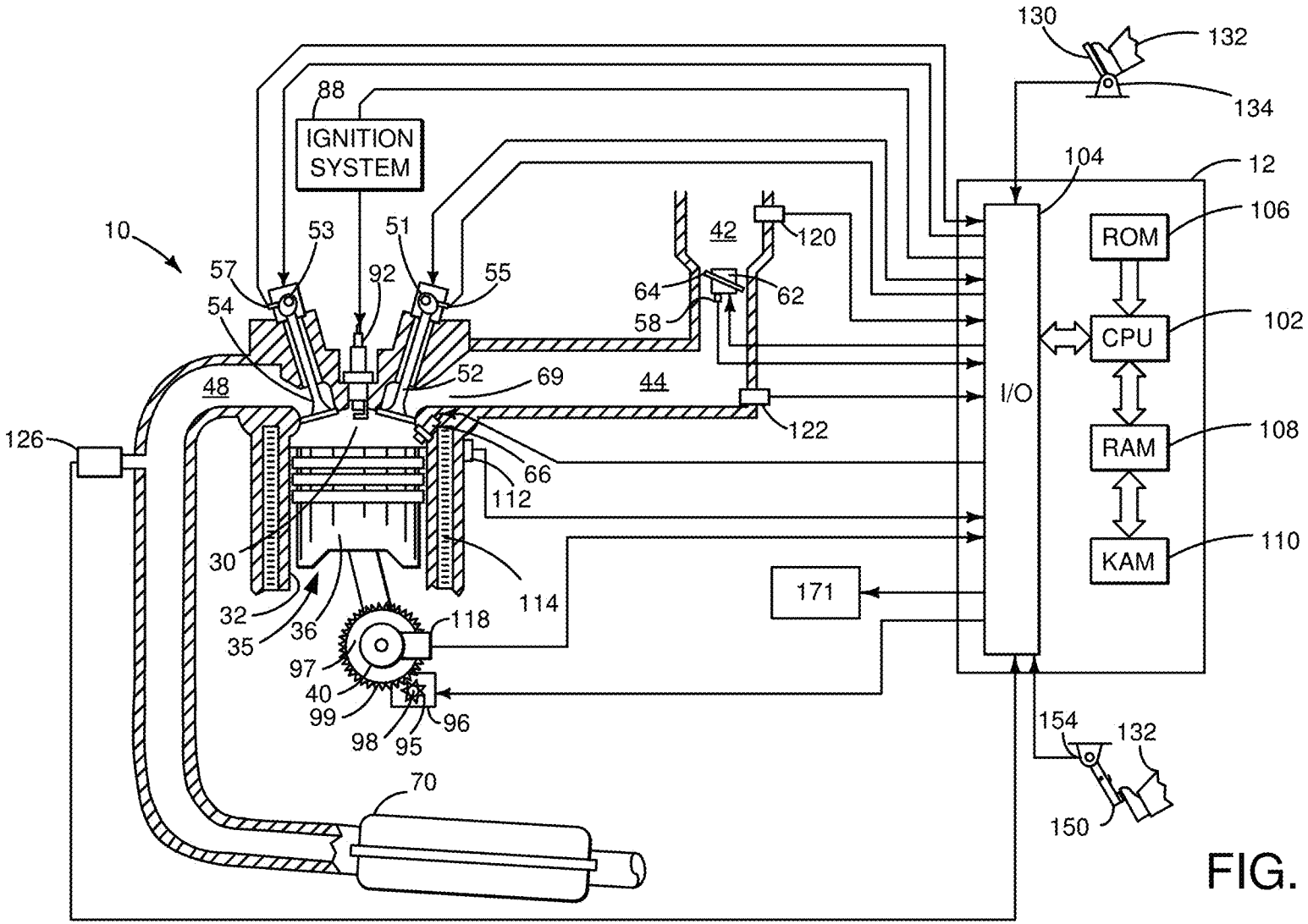
FIG. 1 is a schematic diagram of a single cylinder of an engine.
Figure 8:
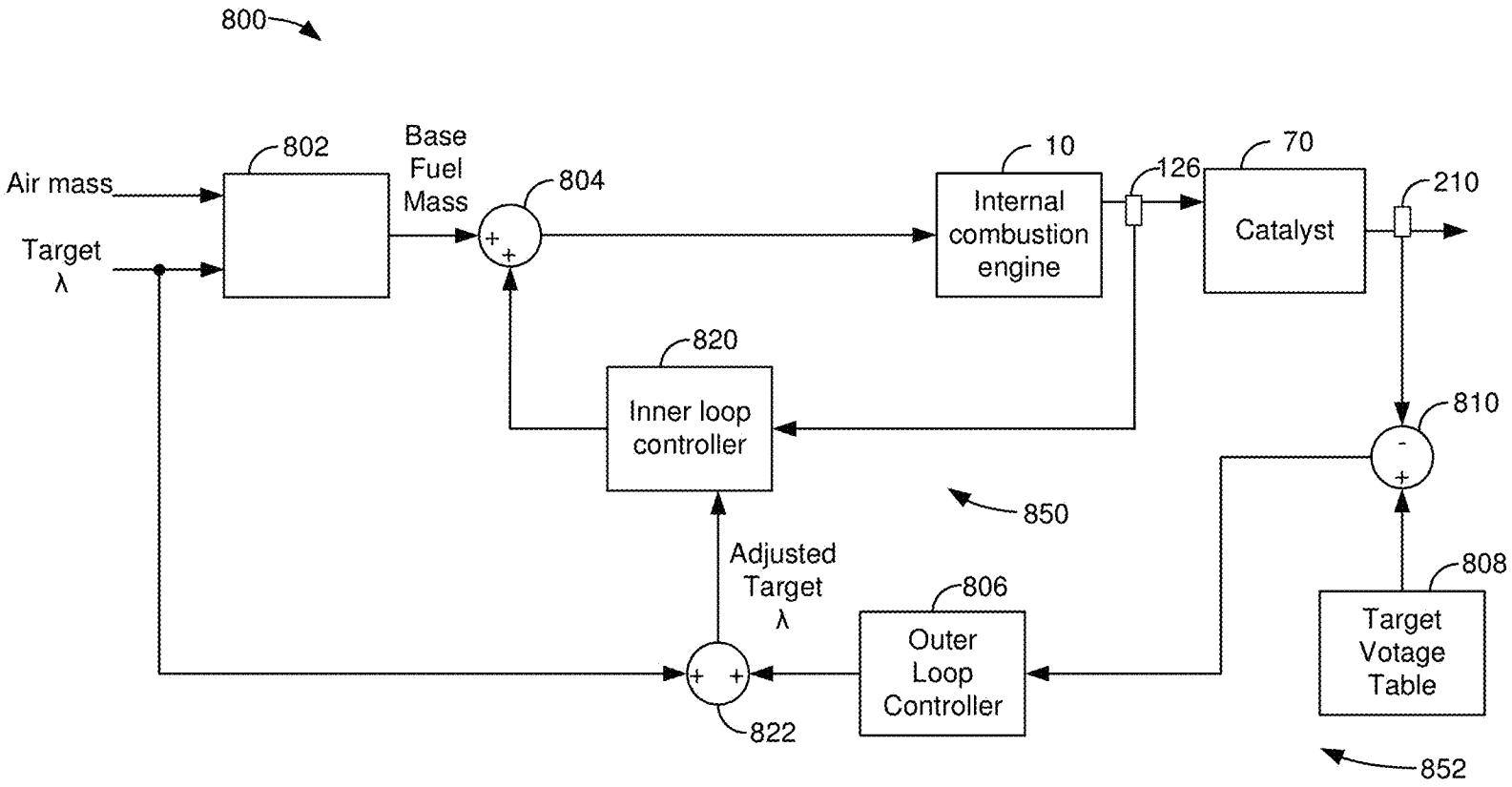
FIG. 8 shows an example fuel control system that includes an inner fuel control loop and an outer fuel control loop.
Figure 9:
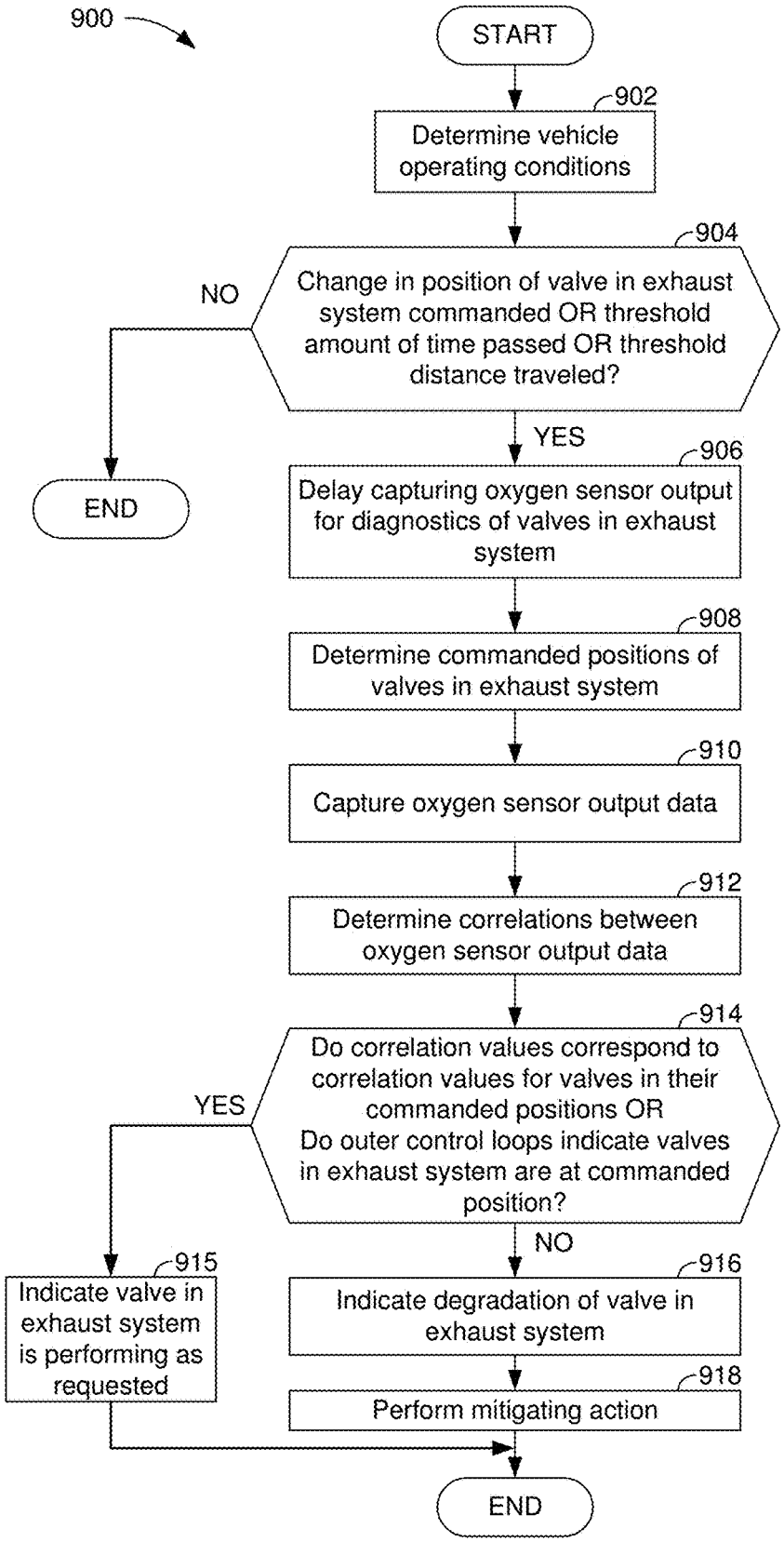
FIG. 9 shows a flowchart of a method for diagnosing valves of an exhaust system via oxygen sensors.

The present description is related to diagnosing operation of valves in an exhaust system that may redirect exhaust flow to reduce engine emissions or reduce catalyst heating. The positions of the exhaust system may be inferred from output of upstream and downstream oxygen sensors. The oxygen sensors may sense exhaust gases from an internal combustion engine as shown in FIG. 1. Example exhaust systems, valves, and valve positions in these exhaust systems are shown in FIGS. 2-7. A block diagram of a fuel control system that includes an inner control loop and an outer control loop is shown in FIG. 8. A flowchart of a method for diagnosing valves in an exhaust system is shown in FIG. 9.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Direct fuel injector 66 is shown positioned to inject fuel directly into cylinder 35, which is known to those skilled in the art as direct injection. Fuel injector 66 delivers liquid fuel in proportion to a voltage pulse width or fuel injector pulse width of a signal from controller 12. Fuel is delivered to fuel injector 66 by a fuel system (not shown) including a fuel tank, fuel pump, and fuel rail (not shown). In addition, intake manifold 44 is shown communicating with optional electronic throttle 62 which adjusts a position of throttle plate 64 to control air flow from air intake 42 to intake manifold 44. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. First upstream oxygen sensor 126 (e.g., universal Exhaust Gas Oxygen (UEGO) sensor, which may be referred to as a wide-band oxygen sensor) is shown coupled to exhaust manifold 48 upstream of catalytic converter 70. Alternatively, a two-state (e.g., narrow band) exhaust gas oxygen sensor may be substituted for first upstream oxygen sensor 126.

Catalytic converter 70 can include multiple catalyst bricks, in one example. In another example, multiple emission control devices, each with multiple bricks, can be used. Catalytic converter 70 can be a three-way type catalyst in one example.

Controller 12 is shown in FIG. 1 as a conventional microcomputer including: microprocessor unit 102, input/output ports 104, read-exclusive memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a driver demand pedal 130 for sensing a distance displaced by human 132; a position sensor 154 coupled to caliper application pedal 150 for sensing distance displaced by human 132, a measurement of engine manifold pressure (MAP) from pressure sensor 122 coupled to intake manifold 44; an engine position sensor 118 that senses a position of crankshaft 40; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses each revolution of the crankshaft from which engine speed (RPM) can be determined.

In some examples, the engine may be coupled to an electric motor/battery system in a hybrid vehicle. Further, in some examples, other engine configurations may be employed, for example a diesel engine with multiple fuel injectors. Further, controller 12 may receive input and communicate conditions such as degradation of components to light, or alternatively, human/machine interface 171.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
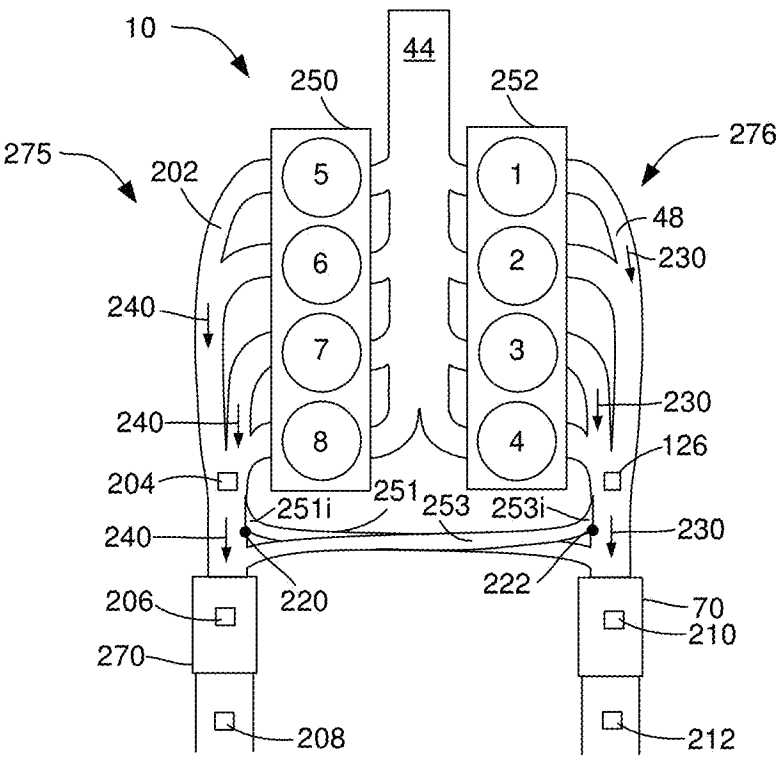
FIG. 2 is a schematic diagram of an eight-cylinder engine with valves arranged in a first configuration in an exhaust system to provide straight exhaust flow through a catalyst.

Referring now to FIG. 2, a plan view 200 of engine 10 is shown. Engine 10 is the same engine as shown in FIG. 1, but in FIG. 2, all engine cylinders are shown. In this example, the engine's cylinders are numbered 1 through 8. The cylinders are supplied with air via intake manifold 44. A right bank of cylinders includes cylinders 1-4 and a left bank of cylinders includes cylinders 5-8. Cylinders 1-4 are shown in fluidic communication with exhaust manifold 48 and cylinders 5-8 are shown in fluidic communication with exhaust manifold 202. Right cylinder bank exhaust system 276 includes exhaust manifold 48 and first upstream oxygen sensor 126. Left cylinder bank exhaust system 275 includes exhaust manifold 202 and second upstream oxygen sensor 204. Each of cylinders 1-8 includes a fuel injector, spark plug, and intake/exhaust valves as shown in FIG. 1.

The engine 10 of FIG. 2 includes catalytic converters 70 and 270 (e.g., close coupled catalysts) that enable fast catalyst light-off when engine 10 is cold started. However, during conditions when the engine is warm and operated at high loads and high speeds for longer periods of time, flowing exhaust gas from left cylinder bank 250 to catalytic converter 270 may cause degradation of catalytic converter 270. In order to reduce a possibility of degrading of catalytic converter 270 during high speed/high load conditions, a position of valve 220 (e.g., left cylinder bank left valve) may be adjusted to direct exhaust to left-to-right crossover pipe 251, which causes exhaust to flow from left cylinder bank 250 to catalytic converter 70. Similarly, in order to reduce a possibility of degrading of catalytic converter 70 during high speed/high load conditions, a position of valve 222 (e.g., a right cylinder bank right valve) may be adjusted to direct exhaust to right-to-left crossover pipe 253, which causes exhaust to flow from right cylinder bank 252 to catalytic converter 270. Left-to-right crossover pipe 251 selectively fluidically couples left cylinder bank exhaust system 275 to right cylinder bank exhaust system 276. Similarly, right-to-left crossover pipe 253 selectively fluidically couples right cylinder bank exhaust system 276 to left cylinder bank exhaust system 275.

In FIG. 2, a first valve configuration where valve 220 is positioned at inlet 251*i* of left-to-right crossover pipe 251 and valve 222 is positioned at inlet 253*i* of right-to-left crossover pipe 253 is shown. Valve 220 is shown in a first position (e.g., a pass through state) where exhaust gas from left cylinder bank 250 bypasses left-to-right crossover pipe 251 and flows a short distance to catalytic converter 270, thereby reducing light-off time of catalytic converter 270 so that engine tailpipe emissions may be reduced. Similarly, valve 222 is shown in a first position where exhaust gas from right cylinder bank bypasses right-to-left crossover pipe 253 and flows a short distance to catalytic converter 70, thereby reducing light-off time of catalytic converter 70 so that engine tailpipe emissions may be reduced. Arrows 240 show a direction of exhaust gas flow from left cylinder bank 250 when valve 220 is blocking exhaust flow from left-to-right crossover pipe 251 as shown. Arrows 230 show a direction of exhaust gas flow from right cylinder bank 252 when valve 222 is blocking exhaust flow from right-to-left crossover pipe 253 as shown.

The first upstream oxygen sensor 126 (e.g., an upstream wide band oxygen sensor (UEGO)) is shown configured to sense exhaust gases from cylinders numbered 1-4 of right cylinder bank 252. The second upstream oxygen sensor 204 (e.g., an upstream wide band oxygen sensor UEGO)) is shown configured to sense exhaust gases from cylinders 5-8 of left cylinder bank 250. A third oxygen sensor 210 (e.g., a downstream narrow band oxygen sensor (HEGO)) is shown configured to sense exhaust gases from within catalytic converter 70, or alternatively, at location 212. A fourth oxygen sensor 206 (e.g., a downstream narrow band oxygen sensor (HEGO)) is shown configured to sense exhaust gases from within catalytic converter 270, or alternatively, at location 208.

Output of first upstream oxygen sensor 126 may be applied as air-fuel or equivalence ratio (e.g., $\lambda$=air-fuel ratio/stoichiometric air-fuel ratio) feedback for controlling fuel that is supplied to cylinders numbered 1-4. Output of second upstream oxygen sensor 204 may be applied as air-fuel or equivalence ratio feedback for controlling fuel that is supplied to cylinders numbered 5-8. Output of third oxygen sensor 210 may be applied as a voltage signal, air-fuel ratio, or equivalence ratio feedback for an outer-loop fuel controller. Output of fourth oxygen sensor 206 (e.g., a downstream oxygen sensor) may be applied as air-fuel or equivalence ratio feedback for an outer-loop controller.

Figure 3:
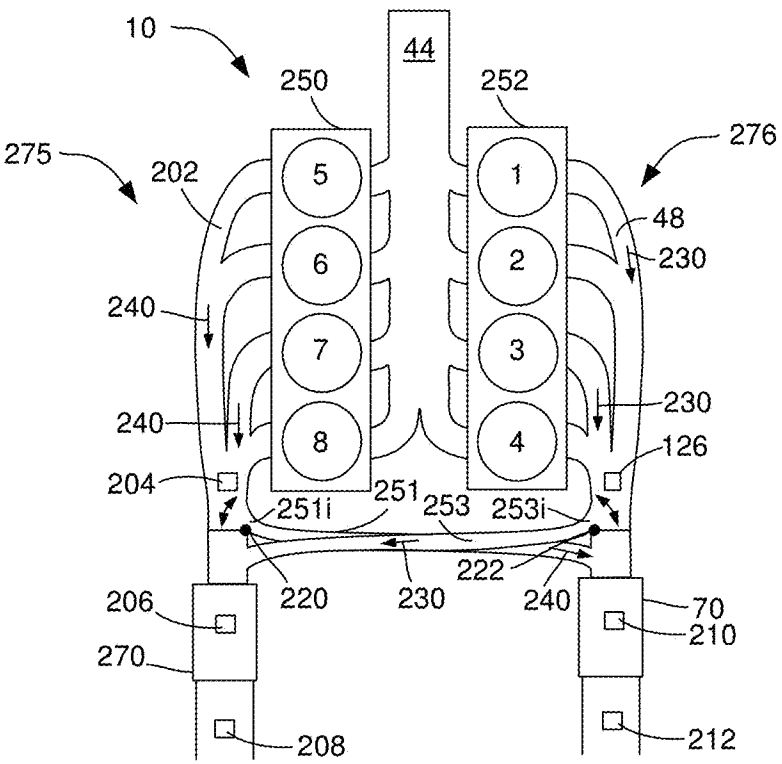
FIG. 3 is a schematic diagram of an eight-cylinder engine with valves arranged in a first configuration in an exhaust system to provide cross-over exhaust flow through a catalyst.

Referring now to FIG. 3, the plan view 200 of engine 10 is shown again. The components of engine 10 are the same as shown in FIG. 2 and the components of engine 10 operate as previously described. Therefore, for the sake of brevity the description of engine 10 and its components is omitted for FIG. 3.

In FIG. 3, valve 220 is positioned at inlet 251*i* of left-to-right crossover pipe 251 and valve 222 is positioned at inlet 253*i* of right-to-left crossover pipe 253. Valve 220 is shown in a second position (e.g., a bypass state) where exhaust gas from left cylinder bank 250 are blocked from entering catalytic converter 270. Instead, exhaust gases from left cylinder bank 250 are directed to left-to-right crossover pipe 251 and the exhaust flows a longer distance to catalytic converter 70, thereby reducing an amount of heat that may be transferred to catalytic converter 70 so that a possibility of catalyst degradation may be reduced. Similarly, valve 222 is shown in a second position where exhaust gas from right cylinder bank 252 are blocked from entering catalyst 70. Rather, exhaust gases from right cylinder bank 252 are directed to right-to-left crossover pipe 253 and exhaust flows a longer distance to catalytic converter 270 so that a possibility of catalyst degradation may be reduced. Arrows 240 show a direction of exhaust gas flow from left cylinder bank 250 when valve 220 is blocking exhaust flow from left cylinder bank 250 to catalytic converter 270 as shown. Arrows 230 show a direction of exhaust gas flow from right cylinder bank 252 when valve 222 is blocking exhaust flow from right cylinder bank 252 to catalytic converter 70. Thus, FIG. 3 shows a configuration where exhaust gases from left cylinder bank are processed via catalytic converter 70 and exhaust gases from right cylinder bank are processed via catalytic converter 270.

Figure 4:
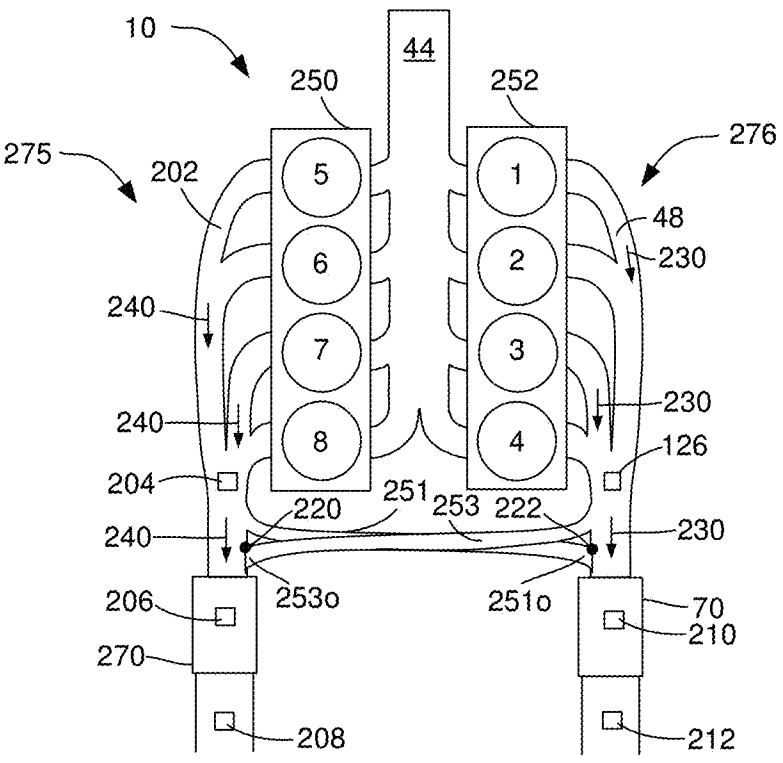
FIG. 4 is a schematic diagram of an eight-cylinder engine with valves arranged in a second configuration in an exhaust system to provide straight exhaust flow through a catalyst.

Referring now to FIG. 4, the plan view 200 of engine 10 is shown again. The components of engine 10 are the same as shown in FIG. 2 and the components of engine 10 operate as previously described. Therefore, for the sake of brevity the description of engine 10 and its components is omitted for FIG. 4.

In FIG. 4, a second valve configuration where valve 220 is positioned at outlet 2530 of right-to-left crossover pipe 253 and valve 222 is positioned at outlet 2510 of left-to-right crossover pipe 251 is shown. Valve 220 is shown in a first position where exhaust gas from right cylinder bank 252 bypasses right-to-left crossover pipe 253 and flows a short distance to catalyst 70, thereby reducing light-off time of catalytic converter 70 so that engine tailpipe emissions may be reduced. Similarly, valve 222 is shown in a first position where exhaust gas from left cylinder bank 250 bypasses left-to-right crossover pipe 253 and flows a short distance to catalytic converter 270, thereby reducing light-off time of catalytic converter 270 so that engine tailpipe emissions may be reduced. Arrows 240 show a direction of exhaust gas flow from left cylinder bank 250 when valve 222 is blocking exhaust flow from left-to-right crossover pipe 251 as shown. Arrows 230 show a direction of exhaust gas flow from right cylinder bank 252 when valve 220 is blocking exhaust flow from right-to-left crossover pipe 253 as shown.

Figure 5:
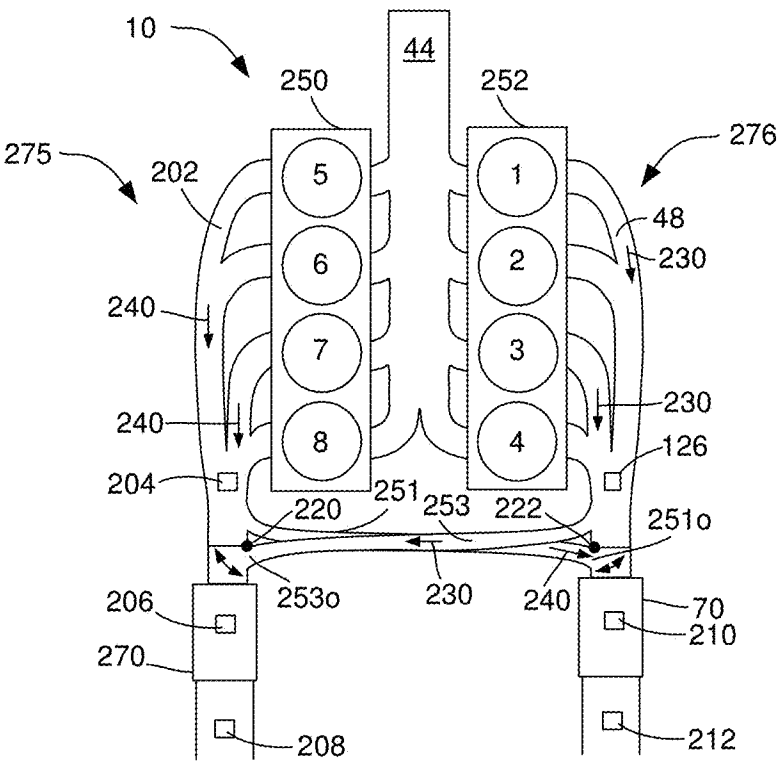
FIG. 5 is a schematic diagram of an eight-cylinder engine with valves arranged in a second configuration in an exhaust system to provide cross-over exhaust flow through a catalyst.

Referring now to FIG. 5, the plan view 200 of engine 10 is shown yet again. The components of engine 10 are the same as shown in FIG. 2 and the components of engine 10 operate as previously described. Therefore, for the sake of brevity the description of engine 10 and its components is omitted for FIG. 5.

In FIG. 5, the second configuration where valve 220 is positioned at outlet 2530 of right-to-left crossover pipe 253 and valve 222 is positioned at outlet 2510 of left-to-right crossover pipe 251 is shown a second time. Valve 220 is shown in a second position where exhaust gas from left cylinder bank 250 is blocked from catalytic converter 270 and it is permitted to flow through left-to-right crossover pipe 251 and catalytic converter 70. Likewise, valve 222 is shown in a second position where exhaust gas from right cylinder bank 252 is blocked from catalytic converter 70 and it is permitted to flow through right-to-left crossover pipe 253 to catalytic converter 270. The second position of these valves allows catalytic converter 70 and catalytic converter 270 to remain cooler even at high engine speeds and loads. Arrows 240 show a direction of exhaust gas flow from left cylinder bank 250 when valve 220 is blocking exhaust flow from left cylinder bank 250 to catalytic converter 270 as shown. Arrows 230 show a direction of exhaust gas flow from right cylinder bank 252 when valve 222 is blocking exhaust flow from right cylinder bank 252 to catalytic converter 70 as shown.

Figure 6:
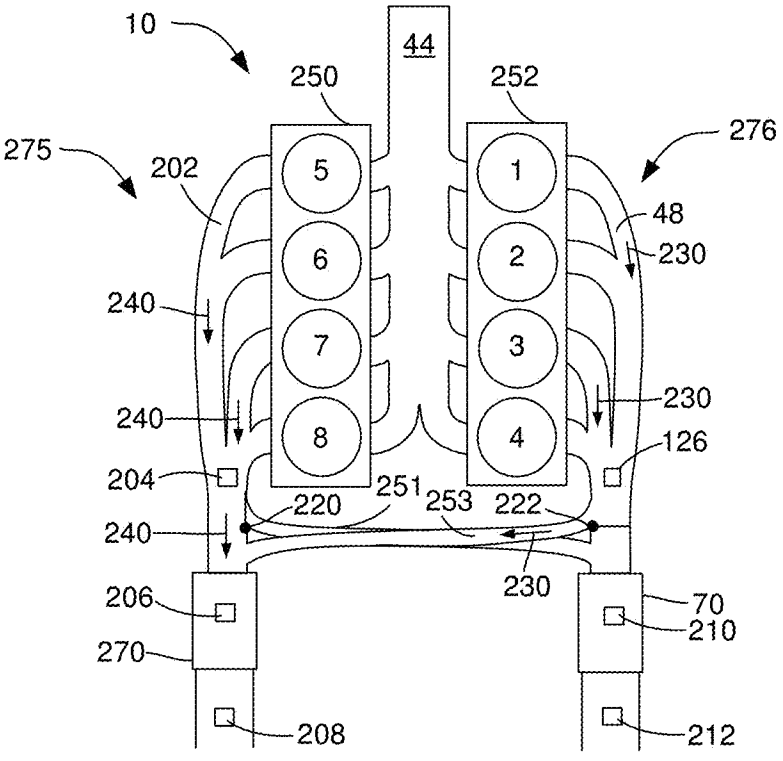
FIG. 6 is a schematic diagram of an eight-cylinder engine with valves arranged in a first configuration in an exhaust system showing a first example degraded valve state.

Referring now to FIG. 6, the plan view 200 of engine 10 is shown again. The components of engine 10 are the same as shown in FIG. 2 and the components of engine 10 operate as previously described. Therefore, for the sake of brevity the description of engine 10 and its components is omitted for FIG. 6.

In FIG. 6, the first valve configuration is shown again, but here valve 220 is operating as commanded and valve 222 exhibits degradation as it has not moved from its second position back to its first position when commanded to do so. Under these conditions, exhaust flows from left cylinder bank as indicated by arrows 240 to catalytic converter 270. Further, exhaust flows from right cylinder bank as indicated by arrows 230 to catalytic converter 270. If valves 220 and 222 take the positions as shown, catalytic converter 270 may have insufficient capacity to process the engine's exhaust gas with a desired level of efficiency. Therefore, it may be desirable to be able to discern whether or not a valve in an exhaust system moves to its commanded position. A similar situation may develop if valve 220 does not move to its first position when it is commanded to do so and valve 222 does move to its first position when it is commanded to do so.

Figure 7:
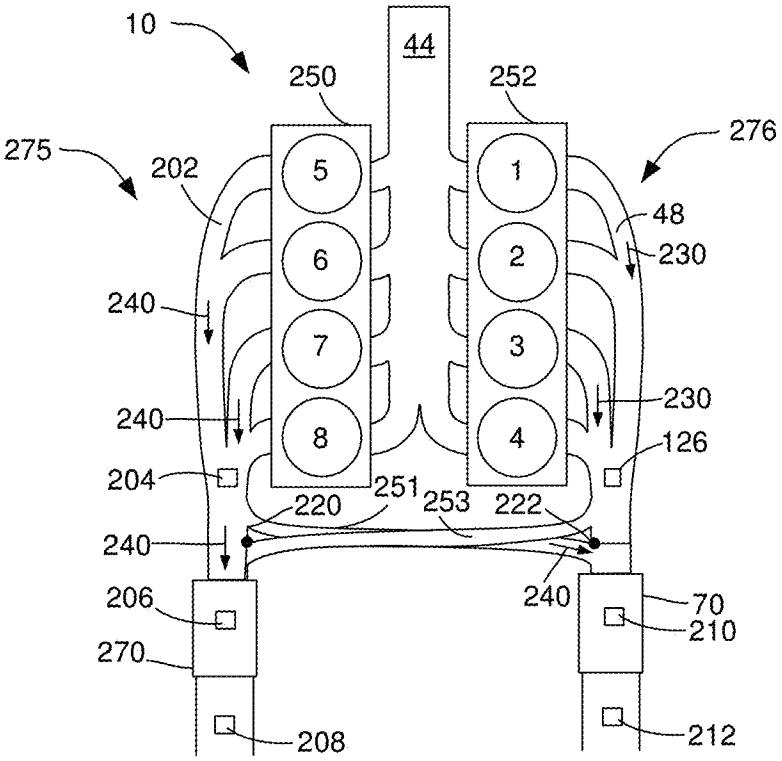
FIG. 7 is a schematic diagram of an eight-cylinder engine with valves arranged in a second configuration in an exhaust system showing a second example degraded valve state.

Referring now to FIG. 7, the plan view 200 of engine 10 is shown again. The components of engine 10 are the same as shown in FIG. 2 and the components of engine 10 operate as previously described. Therefore, for the sake of brevity the description of engine 10 and its components is omitted for FIG. 7.

In FIG. 7, the second valve configuration is shown again, but here valve 220 exhibits degradation as it has not moved from its first position to its second condition when commanded to do so. However, valve 222 has moved from its first position to its second position when commanded to do so. Under these conditions, exhaust flows from left cylinder bank 250 as indicated by arrows 240 to catalytic converter 270 and catalytic converter 70. Further, exhaust flow from right cylinder bank 252 is prevented by valve 220 and valve 222. If valves 220 and 222 take the positions as shown, cylinders 1-4 may not operate and catalytic converter efficiency may not be as high as may be desired. Therefore, it may be desirable to be able to discern whether or not a valve in an exhaust system moves to its commanded position. A similar situation may develop if valve 222 does not move to its second position when it is commanded to do so and valve 220 does move to its second position when it is commanded to do so.

Referring now to FIG. 8, a block diagram 800 of a fuel control system that includes an inner control loop 850, which may be referred to as "inner loop" and an outer control loop 852, which may be referred to as "outer loop" is shown. It may be appreciated that FIG. 8 shows a simplified version of a fuel control system that includes inner and outer loops. Other versions of fuel control systems having inner and outer control loops are also anticipated. The fuel control system that is shown in FIG. 8 may be generated via executable instructions that are stored in non-transitory memory of a controller (e.g., 12 of FIG. 1). A fuel control system as shown in FIG. 8 may be applied to control fuel that is supplied to each cylinder bank. In this example, block diagram 800 pertains to controlling fuel to a first bank of cylinders (e.g., cylinders 1-4 of FIG. 2).

A mass flow rate of air entering the engine and engine speed are input to target fuel mass generator 802. Target fuel mass generator 802 outputs a fuel mass value to summing junction 804. The mass of fuel is based on a mass flow rate of air entering the engine, the number of engine cylinders, engine speed, and a target lambda value (e.g., lambda=air-fuel ratio/stoichiometric air-fuel ratio). Summing junction 804 outputs a fuel mass value and the fuel mass is injected to engine 10. Engine 10 combusts the injected fuel with the inducted air to generate power and exhaust. The exhaust may be sensed via first upstream oxygen sensor 126 (e.g., a wide band oxygen sensor). Untreated exhaust may flow into and be treated via catalytic converter 70. Treated exhaust gases may be sensed via downstream oxygen sensor 210 (e.g., a narrow band heated oxygen sensor). Downstream oxygen sensor 210 is located in or downstream of catalytic converter 70 according to a direction of exhaust flow from engine cylinders to atmosphere.

Inner control loop 850 (summing junction 804, internal combustion engine 10, first upstream oxygen sensor 126, and inner loop controller 820) is nested inside outer control loop 852. Outer control loop 852 also includes summing junction 822, catalytic converter 70, downstream oxygen sensor 210, summing junction 810, target voltage table 808, and outer loop controller 806. Outer loop controller 806 may be a proportional controller, a proportional/integral controller, a proportional/integral/derivative controller, linear controller, non-linear controller, or other known controller. Outer control loop 852 receives a signal (e.g., a voltage) from downstream oxygen sensor 210 and the voltage is subtracted from a target voltage that is received from a target voltage table 808. The target voltage may be output as a function of engine speed and load. Junction 810 outputs a difference or error between the target voltage and the voltage output from the oxygen sensor 210. The outer loop controller 806 receives the voltage error and supplies a bias lambda correction to the inner loop controller 820. The bias correction addresses the catalyst 70 offset state which would not be detected by 820 using only oxygen sensor 126. The bias correction is added to target lambda at summing junction 822 to provide an adjusted target lambda to 820.

Inner control loop 850 includes summing junction 804, internal combustion engine 10, first upstream oxygen sensor 126, and inner loop controller 820. The inner control loop receives signals from first upstream oxygen sensor 126. The signals are converted to lambda values and the inner control loop generates fuel masses (e.g., m1). This mass is added with the base fuel mass at summing junction 804.

The systems of FIGS. 1-8 provides for an engine system, comprising: an engine including a left cylinder bank and a right cylinder bank; a right cylinder bank exhaust system coupled to the right cylinder bank; a left cylinder bank exhaust system coupled to the left cylinder bank; a right to left crossover pipe coupling the right cylinder bank exhaust system to the left cylinder bank exhaust system; a left to right crossover pipe coupling the left cylinder bank exhaust system to the right cylinder bank exhaust system; a right valve positioned along the right cylinder bank exhaust system; a left valve positioned along the left cylinder bank exhaust system; a left upstream oxygen sensor; a right upstream oxygen sensor; a left downstream oxygen sensor; a right downstream oxygen sensor; and a controller including executable instructions stored in non-transitory memory that cause the controller to diagnose operation of the right valve and the left valve via a correlation coefficient generated via outputs of at least one of the left upstream oxygen sensor, the right upstream oxygen sensor, the left downstream oxygen sensor, and the right downstream oxygen sensor. In a first example, the engine system includes where diagnosing operation of the right valve and the left valve includes identifying whether or not the right valve and/or the left valve is stuck. In a second example that may include the first example, the engine system further comprises additional instructions to adjust operation of the engine in response to the correlation coefficient. In a third example that may include one or both of the first and second examples, the engine system further comprises additional instructions to adjust operation of the right valve or the left valve in response to the correlation coefficient. In a fourth example that may include one or more of the first through third example, the engine system further comprises additional instructions to compare the correlation coefficient with a second correlation coefficient. In a fifth example that may include one or more of the first through fourth examples, the engine system includes where the correlation coefficient is generated via integrating output of the left upstream oxygen sensor or the right upstream oxygen sensor. In a sixth example that may include one or more of the first through fifth examples, the engine system further comprises additional executable instructions that cause the controller to generate output of a modeled downstream oxygen sensor. In a seventh example that may include one or more of the first through sixth examples, the engine system includes where the correlation coefficient is generated via integrating output of the modeled downstream oxygen sensor.

Herein, oxygen sensors that are located upstream of a catalyst according to a direction of exhaust flow may be referred to as upstream oxygen sensors (e.g., universal exhaust gas oxygen sensor (UEGOs)). Oxygen sensors that are located within or downstream of a catalyst according to a direction of exhaust flow may be referred to as downstream oxygen sensors (e.g., heated exhaust gas oxygen sensor (HEGOs)).

Referring now to FIG. 9, a flowchart of a method for diagnosing operation of valves within an exhaust system of an internal combustion engine is shown. The method of FIG. 9 may be incorporated to the system of FIGS. 1-8 via executable instructions stored in non-transitory memory of a controller. The method of FIG. 9 may be applied to an engine system that includes two banks of cylinders with two crossover pipes and two valves that control exhaust flow through the two crossover pipes.

At 902, method 900 determines operating conditions. Operating conditions may include but are not constrained to engine speed, engine load, ambient air temperature, catalyst temperature, engine temperature, and driver demand load. Method 900 may determine the operating conditions via the sensors described herein. Method 900 proceeds to 904.

At 904, method 900 judges whether or not a change in a position of a valve in the exhaust system (e.g., valve 220 or valve 222) is commanded to change or if a threshold amount of time has passed since the most recent time the valve in the exhaust system has been commanded to a new position or if the vehicle has traveled a threshold distance since the most recent time the valve in the exhaust system has been evaluated for degradation (e.g., lack of or inadequate valve movement). If method 900 judges that a change in the position of a valve in the exhaust system has been commanded or a threshold amount of time has passed or the vehicle has traveled a threshold distance, the answer is yes and method 900 proceeds to 906. Otherwise, the answer is no and method 900 proceeds to exit.

At 906, method 900 delays capturing oxygen sensor output for diagnostics of valves in the engine's exhaust system following a commanded change in position of the valves. The delay may be a function of flow transport delays and an amount of time it is expected for the valve in the exhaust system to move from a first position to a second position. Method 900 proceeds to 908 after a delay time has passed.

At 908, method 900 determines the commanded position for the valves in the engine's exhaust system. In one example, method 900 may determine the commanded position of the valves in the exhaust system based on values of variables that are stored in controller memory. Method 900 proceeds to 910.

At 910, method 900 begins capturing oxygen sensor output to controller memory. The oxygen sensor output that is captured may be air-fuel ratio or lambda values to controller memory (e.g., random access memory). Method 900 proceeds to 912.

At 912, method 900 determines correlations between different oxygen sensor outputs. Method 900 may compute correlations between upstream oxygen sensor output and downstream oxygen sensor output by first determining oxygen storage of a catalyst. For the left upstream oxygen sensor and the right downstream oxygen sensors, oxygen storage of the right catalyst may be determined via the following equation:

$$\frac{d}{dt}m_{St.O_2}[R](t) = 0.21 \times \dot{m}_{exh}(t)\frac{\lambda[L](t) - 1}{\lambda[L](t) + \frac{1}{AFR_s}} \quad \text{Eq. 1}$$

$$\Rightarrow m_{St.O_2}[R](t) = 0.21 \int m_{exh}(t)\frac{\lambda[L](t) - 1}{\lambda[L](t) + \frac{1}{AFR_s}}dt \quad \text{Eq. 2}$$

where [R] indicates right cylinder bank, [L] indicates the left cylinder bank, $\dot{m}_{exh}(t)$ is exhaust mass flow rate of one cylinder bank with respect to time, λ[L](t) is lambda as measured via a left upstream oxygen sensor as a function of time, AFRs is the stoichiometric air-fuel ratio, and 0.21 corresponds to the fraction of oxygen in air. The modeled right downstream oxygen sensor signal (HEGO_mod[R](t)) may be expressed as a function of the right catalyst oxygen storage:

$$\text{HEGO_mod}[R](t) = f(m_{St.o_2}[R](t)) \quad \text{Eq. 3}$$

where the function $f$ accounts for modeled transportation delays, sensor response, etc. The HEGO signal may be in terms of a voltage, Lambda, or @. The correlation (p) between the left cylinder bank upstream oxygen sensor (e.g., 204) output and the right cylinder bank downstream oxygen sensor (e.g., 210) output may be determined via the following equation:

$$\rho(UEGO[L], HEGO[R]) = \frac{\left(\int_{\Delta t}(x - \bar{x})dt\right)\left(\int_{\Delta t}(y - \bar{y})dt\right)}{\sqrt{\left(\int_{\Delta t}(x - \bar{x})^2 dt\right)\left(\int_{\Delta t}(y - \bar{y})^2 dt\right)}} \quad \text{Eq. 4}$$

where p is the correlation coefficient, x=HEGO_mod[R](t) is the modeled right HEGO sensor output based on the left cylinder bank UEGO output, and x is the average value of x over time period Δt, y=HEGO[R](t) is the right measured HEGO signal, $\bar{y}$ is the average value of y over time period Δt, and Δt is a suitable time for integration.

Similarly, six different correlation coefficient values may be determined. Specifically, ρ(UEGO[R],HEGO[R]): right UEGO sensor signal and right HEGO sensor signal; ρ(UEGO[L],HEGO[R]): left UEGO sensor signal and right HEGO sensor signal; ρ($\overline{\text{UEGO[R], UEGO[L]}}$,HEGO[R]): average of right and left UEGO sensor signals and right HEGO sensor signal; ρ(UEGO[R],HEGO[L]): right UEGO sensor signal and left HEGO sensor signal; ρ(UEGO[L], HEGO[L]): left UEGO sensor signal and left HEGO sensor signal; ρ($\overline{\text{UEGO[R],UEGO[L]}}$,HEGO[L]): average of right and left UEGO sensor signals and left HEGO sensor signal. If there is no valve degradation, ρ(UEGO[R], HEGO[R]) and ρ(UEGO[L], HEGO[L]) would indicate largest correlation coefficient values if direct paths are requested as shown in FIGS. 2 and 4. Additionally, if there is no valve degradation, ρ(UEGO[L], HEGO[R]) and ρ(UEGO[R], HEGO[L]) would indicate largest correlation coefficient values if a crossover pipe paths are requested as shown in FIGS. 3 and 5. The actual valve positions for the valves in the exhaust system may be inferred from the largest correlation values amongst the three correlations involving HEGO[R], and amongst the three correlations involving HEGO[L].

Instead of determining correlation coefficients, oxygen sensor (HEGO) signal model errors (€) for left (e.g., 206) and right (e.g., 210) HEGO sensors may be determined to infer that the exhaust path with the smallest sum of errors or sum of square errors indicates the actual position of the valve in the exhaust system. The oxygen sensor signal model errors may be determined via the following equations:

$$\in(\ldots,\text{HEGO}[R])=\int_{\Delta t}(\text{HEGO_mod}[R](t)-\text{HEGO}[R](t))dt \quad \text{Eq. 5}$$

OR $$\in(\ldots,\text{HEGO}[R])=\int_{\Delta t}(\text{HEGO_mod}[R](t)-\text{HEGO}[R](t))^2dt \quad \text{Eq. 5 alternate}$$

$$\in(\ldots,\text{HEGO}[L])=\int_{\Delta t}(\text{HEGO_mod}[L](t)-\text{HEGO}[R](t))dt \quad \text{Eq. 6}$$

OR $$\in(\ldots,\text{HEGO}[RL])=\int_{\Delta t}(\text{HEGO_mod}[L](t)-\text{HEGO}[L](t))_2dt \quad \text{Eq. 6 alternate}$$

Similar to correlation coefficients, six different errors may be determined: ∈(UEGO[R],HEGO[R]): right UEGO sensor signal (λ[R]) is used to compute HEGO_mod[R](t); ∈(UEGO[L],HEGO[R]): left UEGO sensor signal (λ[L]) is used to compute HEGO_mod[R](t); ∈($\overline{\text{UEGO[R], UEGO[L]}}$,HEGO[R]): average of right and left UEGO sensor signals ($\overline{\lambda[R],\lambda[L]}$) is used to compute HEGO_mod[R](t); ∈(UEGO[R],HEGO[L]): right UEGO sensor signal (λ[R]) is used to compute HEGO_mod[L](t); ∈(UEGO[L],HEGO[L]): left UEGO sensor signal (λ[L]) is used to compute HEGO_mod[L](t); ∈($\overline{\text{UEGO[R],UEGO[L]}}$,HEGO[L]): average of right and left UEGO sensor signals ($\overline{\lambda[R],\lambda[L]}$) is used to compute HEGO_mod[L](t).

As previously shown, a V8 engine's exhaust system may be configured with two crossover pipes and two valves as shown in FIGS. 2-7. In this system, the valves in the exhaust system may be arranged in a first configuration where valve 220 is positioned at inlet 251*i* of left-to-right crossover pipe 251 and valve 222 is positioned at inlet 253*i* of right-to-left crossover pipe 253. Alternatively, the valves may be arranged in a second configuration where valve 220 is positioned at outlet 2530 of right-to-left crossover pipe 253 and valve 222 is positioned at outlet 2510 of left-to-right crossover pipe 251. Based on these two valve arrangements, the following nomenclature may be applied:

TABLE 1

| Abbreviation | Valve configuration | Degradation type |
|---|---|---|
| 1:DD | $1^{st}$ | Double degradation |
| 2:DD | $2^{nd}$ | Double degradation |
| 1:SD | $1^{st}$ | Single degradation |
| 2:SD | $2^{nd}$ | Single degradation |

where double degradation refers to degradation of both valves in the exhaust system (e.g., 220 and 222), and where single degradation refers to degradation of solely one of the valves in the exhaust system being degraded. A comparison between HEGO sensor (e.g., 206 and 210 of FIG. 2) and UEGO sensor (e.g., 204 and 126 of FIG. 2) output may be a basis to determine whether or not one or both of the valves in the exhaust system are degraded (e.g., not operating according to commands). A degradation assessment may be determined via the following table:

TABLE 2

| Valve degradation assessment | Correlation assessment |
|---|---|
| 1:DD; 2:DD; 2:SD[R] | While direct paths are requested, but left bank exhaust flow is diverted to right catalyst: right downstream $O_2$ sensor reading has higher correlation with left upstream $O_2$ sensor and/or left bank fuel command compared to right upstream $O_2$ sensor and/or right bank fuel command. |
| 1:DD; 2:DD; 2:SD[L] | While direct paths are requested, but right bank exhaust flow is diverted to left catalyst: left downstream $O_2$ sensor reading has higher correlation with right upstream $O_2$ sensor and/or right bank fuel command compared to left upstream $O_2$ sensor and/or left bank fuel command. |
| 1:DD; 2:DD; 2:SD[R] | While crossover pipe paths are requested, but right bank exhaust flows into right catalyst: right downstream $O_2$ sensor reading has higher correlation with right upstream $O_2$ sensor and/or right bank fuel command compared to left upstream $O_2$ sensor and/or left bank fuel command. |
| 1:DD; 2:DD; 2:SD[L] | While crossover pipe paths are requested, but left bank exhaust flows into left catalyst: left downstream $O_2$ sensor reading has higher correlation with left upstream $O_2$ sensor and/or left bank fuel command compared to right upstream $O_2$ sensor and/or right bank fuel command. |
| 1:SD[L]; | While direct paths are requested, both cylinder bank exhausts flows are diverted to right catalyst: right downstream $O_2$ sensor reading has higher correlation with |

TABLE 2-continued

| Valve degradation assessment | Correlation assessment |
|---|---|
| | average of right and left upstream $O_2$ sensor and/or average of right and left bank fuel commands compared to right or left upstream $O_2$ sensor reading and/or right or left bank fuel command. |
| 1:SD[R] | While crossover paths are requested, both cylinder bank exhausts flows are diverted to right catalyst: right downstream $O_2$ sensor reading has higher correlation with average of right and left upstream $O_2$ sensor and/or average of right and left bank fuel commands compared to right or left upstream $O_2$ sensor reading and/or right or left bank fuel command. |
| 1:SD[L] | While direct paths are requested, no exhaust flows to left catalyst: left downstream $O_2$ sensor reading may not correlate well with right or left upstream $O_2$ sensor and/or right or left bank fuel commands. |
| 1:SD[R] | While crossover paths are requested, no exhaust flows to left catalyst: left downstream $O_2$ sensor reading may not correlate well with right or left upstream $O_2$ sensor and/or right or left bank fuel commands. |
| 1:SD[R] | While direct paths are requested, both cylinder bank exhausts flows are diverted to left catalyst: left downstream $O_2$ sensor reading has higher correlation with average of right and left upstream $O_2$ sensor and/or average of right and left bank fuel commands compared to right or left upstream $O_2$ sensor reading and/or right or left bank fuel command. |
| 1:SD[L] | While crossover paths are requested, both cylinder bank exhausts flows are diverted to left catalyst: left downstream $O_2$ sensor reading has higher correlation with average of right and left upstream $O_2$ sensor and/or average of right and left bank fuel commands compared to right or left upstream $O_2$ sensor reading and/or right or left bank fuel command. |
| 1:SD[R] | While direct paths are requested, no exhaust flows to right catalyst: right downstream $O_2$ sensor reading may not correlate well with right or left upstream $O_2$ sensor and/or right or left bank fuel commands. |
| 1:SD[L] | While crossover paths are requested, no exhaust flows to right catalyst: right downstream $O_2$ sensor reading may not correlate well with right or left upstream $O_2$ sensor and/or right or left bank fuel commands. |

where the abbreviations (e.g., 1: SD) of table 2 are as indicated in table 1 and where [R] and [L] indicate whether a single degradation is on right or left valve. Thus, valve degradation may be present as indicated in table 2 or if output of an upstream oxygen sensor correlates well with a downstream oxygen sensor, but according to the present valve command the correlation between the upstream oxygen sensor and the downstream oxygen sensor is expected to be low.

For example, while crossover paths are requested using the second valve configuration and left valve is degraded (FIG. 7), exhaust from left bank 250 flows into both right catalyst 70 and left catalyst 270. Since exhaust from left bank flows into left catalyst, left downstream $O_2$ sensor reading exhibits higher correlation with left upstream $O_2$ sensor compared to right upstream $O_2$ sensor indicating potential valve degradation assessments being 2:DD or 2:SD [L] (second valve configurations from Table 2, fourth row). Since exhaust from left bank also flows into right catalyst, right downstream $O_2$ sensor reading does not exhibit higher correlation with right upstream $O_2$ sensor compared to left upstream $O_2$ sensor eliminating potential valve assessments 2:DD and 2:SD [R] (Table 2, third row). Therefore, a degradation assessment may be determined as 2:SD [L].

Alternatively, or in addition, valve degradation may be based on outer-loop fuel controller behavior as indicated in the following table:

TABLE 3

| Valve degradation assessment | Outer loop based assessment |
|---|---|
| 1:DD; 2:DD | Both right and left outer fuel control loops become unstable and both outer loops have correction values at threshold constraints |
| 1:SD[R]; 1:SD[L] | Both right and left outer fuel control loops become unstable, only one outer loop has a correction value that reaches its threshold constraint |
| 2:SD[R]; 2:SD[L] | Left or right outer fuel control loop becomes unstable with a correction being at a threshold constraint level and the other of the outer control loops operates as intended. |

Thus, degradation of valves in an exhaust system may be determined via oxygen sensor or via behavior of an outer loop fuel control system. As such, the financial expense and added complexity of adding valve position sensors may be eliminated or reduced. Method 900 proceeds to 914 after the correlation values have been determined.

At 914, method 900 judges whether or not the various correlation coefficient values determined at step 912 correspond to correlation coefficient values when valves in the exhaust system are at their commanded positions or if the outer fuel control loops indicate that valves in the exhaust system are at commanded positions. If so, the answer is yes and method 900 proceeds to 915. Otherwise, the answer is no and method 900 proceeds to 916.

Method 900 may compare values of correlation coefficients determined at step 912 with values stored in controller memory. If the values determined at step 912 are different than values that where stored in controller memory by more than a predetermined amount, the valve positions that correspond to these off-value correlation coefficients may be determined as being degraded valve positions. Alternatively, if corrections of the outer loops are at their threshold levels, the present commanded valve position may be determined to be degraded.

At 915, method 915 indicates that valves in the exhaust system are in their commanded positions and that they are performing as requested. Method 900 proceeds to exit.

At 916, method 900 indicates degradation of one or more valves in the exhaust system. The indication may be provided via a human/machine interface or other means. Method 900 proceeds to 918.

At 918, method 900 may perform mitigating actions. Mitigating actions may include but are not limited to commanding the valves in the exhaust system to the position they occupied immediately before they were detected as being commanded to a new position at step 904. For example, if the base valve position for both valves (e.g., 220 and 222) is to provide the shortest path for exhausts to catalysts as shown in FIG. 2 and both valves were commanded to the crossover configuration to provide a longest path for exhaust to reach a catalyst as shown in FIG. 3, both valves may be commanded back to the position to provide the shortest path of exhaust to catalysts if one valve was not able to reach the position for the longest path. Thus, if a valve in the exhaust of one cylinder bank does not move to its commanded position, the valve in the exhaust of the other cylinder bank is commanded back to the position so that both valves are providing the longest path or shortest path. On the other hand, if both valves where commanded to provide the shortest path for exhaust to reach a catalyst and valve degradation is indicated, both valves may be commanded back to the crossover configuration to provide a longest path for exhaust to reach a catalyst. Additionally, in some examples, it may be desirable to constrain engine speed to be less than a threshold speed and engine load to be less than a threshold load if there is an indication that the valves are stuck in the position that provides a shortest distance for engine exhaust to reach a catalyst. Method 900 proceeds to exit.

Thus, method 900 and at least portions of the systems shown in FIGS. 1-7 may provide for an exhaust system valve diagnostic method, comprising: via a controller, adjusting a position of a valve in an exhaust system in response to an indication of valve degradation, where the indication of valve degradation is based on output of at least two oxygen sensors. In a first example, the exhaust system valve diagnostic includes where the indication of valve degradation is for a right cylinder bank valve and where the valve is a left cylinder bank valve. In a second example that may include the first example, the exhaust system valve diagnostic method includes where the indication of valve degradation is for a left cylinder bank valve and where the valve is a right cylinder bank valve. In a third example that may include one or both of the first and second examples, the exhaust system valve diagnostic method includes where a first of the at least two oxygen sensors is a right bank upstream oxygen sensor and where a second of the at least two oxygen sensors is a right bank downstream oxygen sensor. In a fourth example that may include one or more of the first through third examples, the exhaust system valve diagnostic method includes where a first of the at least two oxygen sensors is a left bank upstream oxygen sensor and where a second of the at least two oxygen sensors is a left bank downstream oxygen sensor. In a fifth example that may include one or more of the first through fourth examples, the exhaust system valve diagnostic further comprises generating a correlation coefficient from the output of the at least two oxygen sensors. In a sixth example that may include one or more of the first through fifth examples, the exhaust system valve diagnostic method includes where the indication of valve degradation is further based on the correlation coefficient.

Thus, method 900 and at least portions of the systems shown in FIGS. 1-7 may provide for an exhaust system valve diagnostic method, comprising: via a controller, adjusting a position of a valve in an exhaust system in response to an indication of valve degradation, where the indication of valve degradation is based on a correlation coefficient value or an oxygen sensor signal model error. In a first example, the method includes where the correlation coefficient is based on output of a right upstream oxygen sensor and a right downstream oxygen sensor. In a second example that may include the first example, the method includes where the correlation coefficient is based on output of a right upstream oxygen sensor and a left downstream oxygen sensor. In a third example that may include one or both of the first and second examples, the method includes where the oxygen sensor signal model error is based on output of a left upstream oxygen sensor and right downstream oxygen sensor. In a fourth example that may include one or more of the first through third examples, the method includes where the oxygen sensor signal model error is based on output of a right upstream oxygen sensor and right downstream oxygen sensor.

Note that the example control and estimation routines included herein can be used with various engine and/or vehicle system configurations. In addition, although the methods included herein refer to lambda control, the approaches herein may be applied with other units. For example, the approaches herein describe lambda control, but in other examples, the controls and methods may be configured for air-fuel ratio control. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

What is claimed is:

1. An engine system, comprising:

an engine including a left cylinder bank and a right cylinder bank;

a right cylinder bank exhaust system coupled to the right cylinder bank;

a left cylinder bank exhaust system coupled to the left cylinder bank;

a right to left crossover pipe coupling the right cylinder bank exhaust system to the left cylinder bank exhaust system;

a left to right crossover pipe coupling the left cylinder bank exhaust system to the right cylinder bank exhaust system;

a right valve positioned along the right cylinder bank exhaust system;

a left valve positioned along the left cylinder bank exhaust system;

a left upstream oxygen sensor;

a right upstream oxygen sensor;

a left downstream oxygen sensor;

a right downstream oxygen sensor; and a controller including executable instructions stored in non-transitory memory that cause the controller to diagnose operation of the right valve and the left valve via a correlation coefficient generated via outputs of at least one of the left upstream oxygen sensor, the right upstream oxygen sensor, the left downstream oxygen sensor, and the right downstream oxygen sensor.

2. The engine system of claim 1, where diagnosing operation of the right valve and the left valve includes identifying whether or not the right valve and/or the left valve is stuck.

3. The engine system of claim 1, further comprising additional instructions to adjust operation of the engine in response to the correlation coefficient.

4. The engine system of claim 1, further comprising additional instructions to adjust operation of the right valve or the left valve in response to the correlation coefficient.

5. The engine system of claim 1, further comprising additional instructions to compare the correlation coefficient with a second correlation coefficient.

6. The engine system of claim 1, where the correlation coefficient is generated via integrating output of the left upstream oxygen sensor or the right upstream oxygen sensor.

7. The engine system of claim 1, further comprising additional executable instructions that cause the controller to generate output of a modeled downstream oxygen sensor.

8. The engine system of claim 7, where the correlation coefficient is generated via integrating output of the modeled downstream oxygen sensor.

* * * * *